United States Patent [19]

Dellinger

[11] 4,384,616

[45] May 24, 1983

[54] METHOD OF PLACING PIPE INTO DEVIATED BOREHOLES

[75] Inventor: Thomas B. Dellinger, Duncanville, Tex.

[73] Assignee: Mobil Oil Corporation, New York, N.Y.

[21] Appl. No.: 210,913

[22] Filed: Nov. 28, 1980

[51] Int. Cl.[3] ..... E21B 33/14; E21B 41/00; E21B 43/00

[52] U.S. Cl. ..... 166/376; 166/381; 166/386

[58] Field of Search ..... 166/381, 383, 386, 387, 166/285, 50, 67, 350, 376

[56] References Cited

U.S. PATENT DOCUMENTS

| | | | |
|---|---|---|---|
| 2,107,327 | 2/1938 | Creighton | 166/290 |
| 2,698,054 | 12/1954 | Brown et al. | 166/381 |
| 2,935,129 | 5/1960 | Allen et al. | 166/280 |
| 3,398,794 | 8/1968 | Fox, Jr. | 166/381 X |
| 3,526,280 | 9/1970 | Aulick | 166/381 X |

*Primary Examiner*—Stephen J. Novosad

*Attorney, Agent, or Firm*—C. A. Huggett; M. G. Gilman; J. F. Powers, Jr.

[57] ABSTRACT

A method of pushing pipe (e.g., casing) into a highly deviated borehole. The lower end of the pipe is plugged and the lower portion of the pipe string is filled with fluids (e.g., compressed gases, petroleum products, water, etc.) which have a lower density than that of the borehole fluid. This creates a buoyancy effect for the pipe in the deviated portion of the borehole which aids in keeping the pipe from contacting the lower side of the deviated hole. The pipe can be plugged or capped above the lightened section and filled with heavier fluid to aid in forcing the pipe downward into position. The plugs and caps are then removed, e.g., drilled out, when the pipe is ready for use. The fluids are thereby released into the mud slurry.

6 Claims, 3 Drawing Figures

METHOD OF PLACING PIPE INTO DEVIATED BOREHOLES

BACKGROUND OF THE INVENTION

1. Field of the Invention

The present invention relates generally to well operations and, more particularly, pertains to a method of placing pipe, such as casing, within a highly deviated borehole.

The present state of the art related to well drilling has developed techniques to drill boreholes which angularly deviate from the vertical axis that extends downwardly from the drilling rig. It has, therefore, become necessary to devise a method for the placement of pipe longitudinally throughout the borehole regardless of the degree of deviation of the borehole from the vertical axis of the drilling rig.

2. Discussion of the Prior Art

The inventive arrangement provides a method for the placement of pipe longitudinally within the borehole by pushing the pipe through the vertical portion of the borehole down to the deviated portion of the borehole, subsequently filling the pipe with fluid having a lower density than the surrounding fluids, and then further forcing the pipe into and through the deviated zone of the borehole. Upon the final placement of the pipe within the borehole, the fluids are subsequently released into the mud slurry surrounding the pipe. The pipe is then in the desired position within the borehole and can be readily used.

As is well known in the prior art, numerous problems are encountered in pushing pipe down into a borehole which has a high angle of deviation from the vertical axis of the drilling rig. The major problem encountered in attempting to push a pipe through the deviated zone is the contacting of the pipe with the wall of the drilled borehole. In the non-vertical portion of the hole, or what is commonly referred to as the deviation zone, the borehole deviates from the vertical axis of the drill rig. Consequently, the pipe is forced against the wall of the borehole by the downward force provided at the drill rig. Additionally, the weight of the pipe itself forces the pipe to rest against the side of the borehole and, because of friction, causes a force opposite to the direction of the desired advance of the pipe. The greater the weight of the pipe, and the greater the borehole's angle from the vertical axis of the rig, the greater the drag force opposing the downward movement of the pipe. The downward applied force, as well as the weight of the pipe itself, produces a formidable frictional drag force acting against the downward movement of the pipe.

In addition to this drag force, as the pipe lays against the side of the borehole, the pipe displaces some of the filter cake, or wall of the borehole, thereby embedding itself into the cake forming an effective pressure seal within the embedded area. In the permeable sections of the formation, a loss of pressure between the fluid in the borehole and the fluid in the formation causes a force across this pressure seal to further push the pipe against the wall. This force may cause the pipe to become what is commonly called "differentially stuck". Consequently, the forces which hinder the downward movement of the pipe, notably frictional forces and the pressure differential force, vary directly with the force of the pipe which is directed against the borehole wall. As a result of the creation of these forces, it is considered highly desirable to minimize the contact of pipe to borehole wall. By minimizing such contact, the applied force required to push the pipe down the borehole will also be minimized.

The present invention effectively alleviates the aforementioned problems related to the differential sticking and drag forces associated with pipe being forced down into a deviated borehole. None of the prior art arrangements directed to solving these problems do so as effectively and inexpensively as the present invention. None of the prior art, of which Aulick U.S. Pat. No. 3,526,280 is most pertinent, show or even suggest the method of the present invention herein described.

As is illustrated in Aulick U.S. Pat. No. 3,526,280 a related well completion operation is outlined therein for highly deviated wells. As described therein, cement slurry is pumped down into the hole to partially displace and replace the mud slurry. The lower portion of the casing string is filled up with fluid of lower density than the cement slurry, thereby providing a buoyancy effect to the lower chamber of the casing string. Centralizers are further provided throughout the length of the casing string to minimize contact of pipe to borehole wall. The buoyancy chamber causes the pipe to float through the deviation zone of the well, thus avoiding extreme centralizer and casing deflections. This patent provides, therefore, a more complicated apparatus to overcome some of the same problems that the present invention is directed towards. However, this patent is inapplicable in very deep, highly deviated, wells. More particularly, the combination of slow-forming cement slurry, fluids and numerous centralizers, well known in the prior art, are combined to minimize the contact of the leading end of the pipe and the borehole wall. In the present invention, the placement of the pipe throughout the borehole is effected by the use of the fluid itself with no need for centralizers or slow-setting cement slurry. Additionally, Aulick is inapplicable in deep well applications. Where the wells are particularly deep, the flotation chamber described in Aulick will have insufficient bouyant capability to prevent the contact of the pipe with the borehole wall at a great distance from the chamber. As a result, great centralizer and casing deflections will occur. The pipe which is at a distance from the flotation chamber will come into contact with the borehole wall thereby creating the drag forces and the subsequent differential sticking problems, thereby rendering the teaching of this patent insufficient in regards to problems encountered when extremely long lengths of pipe are to be used.

The method of the present invention described herein overcomes these aforementioned problems. Contrary to the teachings of the Aulick patent, the present invention provides a method wherein the pipe being pushed down into the borehole can have differing lengths of pipe containing different fluids to aid in centering the pipe. This advantage is especially desirable in deep wells which have differing angles of declination at different points along the borehole's length. The operation of the rig can, in effect, control the bouyancy along the entire length of pipe being pushed down as required by the particular circumstances of the drilling operation, unlike in the prior art.

SUMMARY OF THE INVENTION

Accordingly, it is a primary objective of the present invention to provide an improved method for the placement of pipe within a borehole.

Another object of the present invention is to provide a method which effectively places the pipe throughout the depth of the borehole with a minimum of required downward force.

A further object of the present invention is to provide an effective method of forcing the pipe downwardly into a very deep borehole with a large angle of deviation from the vertical axis of the drilling rig.

Still, another object of the present invention is to provide a more economical and efficient method for placing a pipe into a deviated borehole.

The present invention provides a novel method for the placement of a pipe in a deviated borehole by utilizing fluids intermittently spaced throughout the pipe thereby providing a flotation of the pipe within the mud slurry of the borehole to minimize any contact between the pipe and the borehole wall.

BRIEF DESCRIPTION OF THE DRAWINGS

The foregoing and other objects, advantages and characterizing features of the inventive method herein described will become more readily apparent from the following detailed description of a preferred embodiment thereof, taken in conjunction with the accompanying drawings wherein like reference numerals denote similar parts throughout the various views and in which.

DESCRIPTION OF THE PREFERRED EMBODIMENTS

Figure 1:
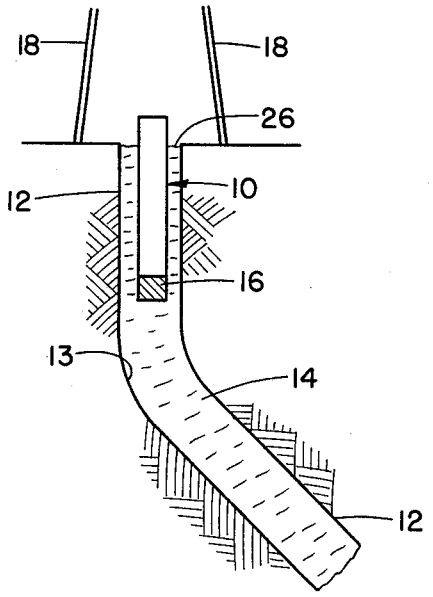
FIG. 1 is a longitudinal sectional view of the pipe which is being lowered into the mud slurry through the vertical portion of the borehole.
Figure 2:
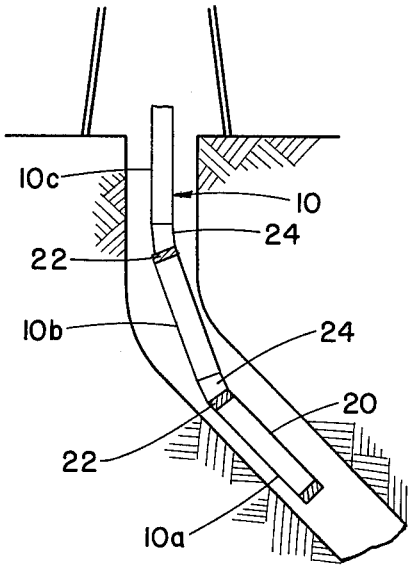
FIG. 2 is a longitudinal sectional view of the pipe being forced through the vertical and deviation zone of the borehole.

Referring now in detail to the drawings, in FIG. 1 there is shown a pipe 10 lowered into the borehole 12 which has been drilled and filled with a mud slurry 14. The pipe 10 can be any pipe such as a casing or a drill string provided that the pipe is not permeable to gases or low density fluids. The pipe 10 has, at its lower-most end a pipe plug 16 which is well known in the art of well-drilling. The pipe 10 is lowered to the depth where the borehole 12 begins to deviate from the vertical axis of the drilling rig 18 partially shown in FIG. 1 After the pipe has been lowered to the appropriate depth the pipe is filled with a low-density fluid 20 as shown in FIG. 2.

The low density fluids 20 are utilized to provide a buoyant effect to that portion of the pipe which contain the fluids. The fluids utilized should be either completely soluble or reactive to the displaced mud 14. Some gases, such as air may cause large gas bubbles in the mud and would in general create unfavorable well bore conditions. The problems of such gases returning to the surface entrance 6 of the borehole could be quite severe. More particularly, air returning through the annular space of the borehole, could create a loss of hydrostatic pressure in the annulus and the well would have to be treated as a "kick" and the well would be closed to control said "kick" condition. Therefore, certain gases have been proposed to be used such as carbon dioxide, sulphur dioxide or hydrogen sulphide. These gases are soluble or reactive in the typical alkaline mud system. These gases are given merely as examples and not be construed to limit the invention herein. Therefore, their release into the mud 14 would not cause a loss of hydrostatic pressure. After filling, a flow-restricting type cap 22 is put into the pipe to prevent leakage of the fluid 20 into the atmosphere or mud slurry 14. Consequently, a connector 24 is attached to a length of pipe **10*a* and another length of pipe 10*b* is attached thereto. This is continued in like fashion until the entire pipe extends throughout the borehole 12 or as deeply as desired. It should be understood that it is anticipated that the lengths of pipe may vary greatly. For example, the length of pipe 10*b* containing mud slurry 10*b* may be 100 feet in length, whereas the pipe 10*a*** containing low density fluid (air, for example) may be, for example, 400 feet in length.

Figure 3:
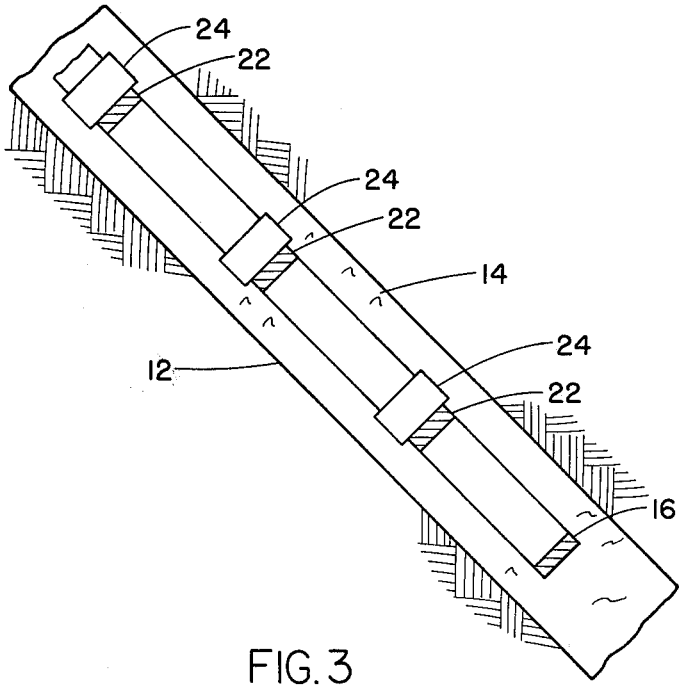
FIG. 3 is a longitudinal sectional view of the lower end of the pipe showing differing sections thereof.

In FIG. 3 there is shown a segment of the borehole 12 which is deep below the entrance 26 of the borehole. There is shown the centering effect of the fluid filled portions **10*a* and 10*c*. These typical segments of the pipe 10 buoyantly support the pipe within the mud 14 to minimize the contact of the pipe 10 with the borehole wall 13. The mud slurry 14 within pipe segment 10*b* is used to counteract the overall flotation of the pipe 10 as well as to provide extra weight in aiding the forcing down of the pipe 10** through the mud slurry.

In operation, the pipe 10 is pushed down into the mud 14 by weight and downward forces applied at the entrance 26 of the borehole 12. The pipe is then filled with fluid 20 and is then further pushed deeper into the borehole 12. Upon final placement of the pipe 10 there will normally be alternating segments within the pipe, wherein some segments will be filled with fluid 20 having lower density than the outer mud 14 and other segments will be filled with the same mud 14 as found in the borehole 12. This mud 14 helps in forcing the pipe 10 further into the borehole 12. The flow-restricting caps 22 and lower end plug 16 are then drilled out releasing the fluids 20 into the mud slurry 14. These fluids remain in solution or react with the mud 14 in a harmless fashion thereby allowing the pipe 10 to be used for its intended purpose. The present invention thereby provides a simple yet effective method for placing a pipe deep within a deviated borehole.

From the foregoing, it is apparent that the objects of the present invention have been fully accomplished. As a result of the present invention, a novel method for the placement of a pipe in a borehole has been provided. Although a preferred embodiment of the principles of this invention has been described and illustrated in detail herein, it should be realized that the same are not limited to the particular configuration shown in the drawings, and that modifications thereof are contemplated and can be made without departing from the broad spirit and scope of this invention as defined in the appended claims.

I claim:

1. A method of positioning pipe in a well borehole which is deviated from a vertical position, while minimizing problems caused by contact of the pipe in the deviated borehole, comprising:

a. plugging the forward end of the pipe to be positioned within the borehole;

b. feeding the pipe downwardly into the borehole;

c. filling a first length of the pipe with a fluid having a density lower than that of the surrounding mud slurry to render the first length of pipe more buoyant relative to the surrounding mud slurry;

d. plugging the pipe with a flow restrictor above the first length of pipe filled with the lower density fluid;

e. filling a second length of the pipe above said flow restrictor with a second fluid having a density higher than that of the lower density fluid to assist in urging the pipe downwardly through the deviated borehole;

f. feeding the pipe, including the second length thereof, downwardly into the borehole, such that the higher density fluid assists in urging the pipe downwardly in the deviated borehole; and g. removing the fluids from the pipe by utilizing fluids which are soluble in, or reactive to, the mud slurry and includes the step of drilling through said flow restrictor and the plugged end of the pipe, thereby releasing the fluids into mud slurry surrounding the pipe within the borehole.

2. A method of positioning pipe in a well borehole as claimed in claim 1, wherein the second fluid comprises mud slurry.

3. A method of positioning pipe in a well borehole which is deviated from a vertical position, while minimizing problems caused by contact of the pipe in the deviated borehole, comprising:

a. plugging the forward end of the pipe to be positioned within the borehole;

b. feeding the pipe downwardly into the borehole;

c. filling a first length of the pipe with a fluid having a density lower than that of the surrounding mud slurry to render the first length of pipe more buoyant relative to the surrounding mud slurry;

d. plugging the pipe with a flow restrictor above the first length of pipe filled with the lower density fluid;

e. filling a second length of the pipe above said flow restrictor with a second fluid having a density higher than that of the lower density fluid to assist in urging the pipe downwardly through the deviated borehole;

f. feeding the pipe, including the second length thereof, downwardly into the borehole, such that the higher density fluid assists in urging the pipe downwardly in the deviated borehole;

g. plugging the pipe with a flow restrictor above the second length of pipe filled with the second fluid;

h. filling a third length of the pipe with a fluid having a density lower than that of the surrounding mud slurry to render the third length of pipe more buoyant relative to the surrounding mud slurry;

i. plugging the pipe with a flow restrictor above the third length of pipe filled with the lower density fluid; and j. filling a fourth length of the pipe above the flow restrictor which is above the third length of pipe, with a second fluid having a density higher than that of the lower density fluid to assist in urging the pipe downwardly through the deviated borehole.

4. A method of positioning pipe in a well borehole as claimed in claim 3, wherein the second fluid comprises mud slurry.

5. A method of positioning pipe in a well borehole as claimed in claim 3, further including the step of removing the fluids from the pipe.

6. A method of positioning pipe in a well borehole as claimed in claim 5, wherein said step of removing is accomplished by utilizing fluids which are soluble in, or reactive to, the mud slurry and includes the step of drilling through said flow restrictors and the plugged end of the pipe, thereby releasing the fluids into mud slurry surrounding the pipe within the borehole.

* * * * *